US006544156B2

(12) United States Patent
Anderson

(10) Patent No.: US 6,544,156 B2
(45) Date of Patent: Apr. 8, 2003

(54) ELASTOMER ROLL FOR PAPERMAKING MACHINE

(75) Inventor: D. W. Anderson, Middletown, NY (US)

(73) Assignee: International Paper Company, Stamford, CT (US)

( * ) Notice: Subject to any disclaimer, the term of this patent is extended or adjusted under 35 U.S.C. 154(b) by 89 days.

(21) Appl. No.: 09/843,735

(22) Filed: Apr. 30, 2001

(65) Prior Publication Data

US 2001/0015141 A1 Aug. 23, 2001

Related U.S. Application Data

(62) Division of application No. 09/267,353, filed on Mar. 15, 1999, now Pat. No. 6,257,133.

(51) Int. Cl.[7] ..... B23P 15/00

(52) U.S. Cl. ..... 492/8; 492/56; 492/59; 492/54; 492/58; 100/162 B

(58) Field of Search ..... 492/8, 48, 53, 492/56, 54, 58, 59; 100/35, 47, 155 R, 162 B, 176, 917

(56) References Cited

U.S. PATENT DOCUMENTS 4,500,471 A * 2/1985 Cotter et al. ..... 562/856
5,290,821 A * 3/1994 Sakurai et al. ..... 521/82
5,383,371 A * 1/1995 Laitinen ..... 73/862.55
5,390,974 A * 2/1995 Theodorakakos ..... 296/146.9
5,607,996 A * 3/1997 Nichols et al. ..... 524/439
5,609,353 A * 3/1997 Watson ..... 280/5.516
5,634,606 A * 6/1997 Roder ..... 242/555.3
5,961,899 A * 10/1999 Rosetti et al. ..... 264/40.1

OTHER PUBLICATIONS

Kany,r and Shaw, M., "Enhances Electrorheological Fluids Using Anisotropic Particles", pp. 657–670. Journal of Rheology, May/Jun. 1998,vol. 42, issue 3.*

Rankin P. and Kingenber, D., "The Electrorheology of Barium titanate suspensions," pp. 639–659. Journal of Rheology, May/Jun. 1998, vol42, issue 3.*

Yao,N. and Jamieson, A. "Electrortheological Creep Tesponse of tumbling Nematics," pp/603–619. Journal of Rheology, May/Jun. 1998, vol. 42, issue 3.*

* cited by examiner

*Primary Examiner*—I Cuda Rosenbaum
(74) *Attorney, Agent, or Firm*—Michael J. Doyle

(57) ABSTRACT

A method and apparatus for obtaining a desired nip pressure distribution profile in the cross direction of a paper web. The paper web passes through a nip, the latter defined by at least one elastomer covered roll, the covered roll having polarizable particles or magnetic particles embedded therein. A plurality of spaced plates or spaced coils each generate a local field (respectively electric or magnetic) which acts upon individual spaced zones or regions along the covered roll. The field may thus be an electric field or a magnetic filed. The effect of the field is to change the effective modulus of the elastomer by acting on the particles. In turn, this action varies the nip pressure pulse as to exert a desired pressure at each of a plurality of spaced zones or regions on the paper web, to thus create or process a more uniform product in the nip. The method and apparatus can be used, for example, to improve web moisture profiles in the press section of paper machines.

10 Claims, 4 Drawing Sheets

ELASTOMER ROLL FOR PAPERMAKING MACHINE

This is a division of application Ser. No. 09/267,353 filed Mar. 15, 1999, now U.S. Pat. No. 6,257,133.

BACKGROUND OF THE INVENTION

This invention relates to papermaking and more particularly to a method and apparatus for reducing streaking in a paper web during its manufacture. In the papermaking field, the term "streaking" refers to non-uniformity of a paper web across its width, the latter often referred to as the cross direction and denoted as CD. One of the most troublesome CD streaking effects is due to variations of moisture content.

Uniformity of moisture, caliper, smoothness and weight profiles across the width of a paper web are critical to efficient production. In many instances, the product is treated or processed in some manner to a greater and undesirable degree than ideal, as a simple result of cross-machine direction (CD) moisture profile variability.

A familiar example is over-drying the web in the main dryer section of a paper machine to a very low moisture content at the size press in order to reduce the magnitude of moisture peaks that would otherwise occur. Such moisture peaks may originate in the forming process, press section or dryer section for any number of reasons. Over-drying, i.e., drying product to an average moisture content below what is considered ideal, can be accomplished by operating the machine at a slower speed, which significantly reduces productivity and value of the operation. Alternatively, over-drying can be accomplished by adding additional heat to the web during its drying stage, which adds considerably to the manufacturing costs.

The low productivity and/or increased energy costs discussed above are consequences of dealing with excessive CD moisture variation. In addition, moisture variability has a negative impact on product quality. For example, the development of web compaction, wet and dry web strength, sizing efficiency, surface smoothness and stress concentrations in the web are all functions of web moisture, thereby producing similar variability in web properties across the width of the web. Eliminating or reducing the moisture variability early in the papermaking process would be extremely valuable to the paper industry.

While these methods for reducing moisture variability are in common use throughout the industry, they can be considered as treating the symptoms and not the root cause of the problem. In many cases, the root cause is moisture streaks originating in the press section. Such streaks may result from roll cover wear profiles, shower pluggage, or non-uniform development of felt compaction, felt void volume, web release properties, and the like. In addition to streaking due to unevenness in the apparatus and elements which contact the paper web during its manufacture, it may also be caused by naturally occurring zones of unevenness of caliper across the web width, or other naturally occurring anisotropies in the paper, as the web is progressively formed. As an example, if the paper web is formed with one or more width-wise zones thicker than all of the remaining width-wise zones of the web, then upon the web passing through the nip of two rolls, those thicker zones will be squeezed more than all of the other zones, and hence will exhibit different moisture contents. Hence even if the nip of two given rolls were to exert a perfectly uniform pressure on a web of perfectly uniform caliper (thickness), those same two rolls squeezing a paper web of non-uniform thickness, weight, or moisture content would yield a web of non-uniform moisture, thickness, smoothness, or other web property in the cross direction (CD), and streaking would result.

Existing methods for improving moisture uniformity in the press section include crowning of press roll covers, use of profiling steam boxes (or profiling infrared energy), control-crowned rolls and various conditioning treatments to the press section clothing (localized chemical or mechanical cleaning of press felts). All of these have proven useful to various degrees, but have severe limitations. Crowning of the press roll covers, for example, is useful for generating a level nip loading across the width of the machine, but cannot be used to influence moisture at a certain CD location. In addition, a fixed cover crown is appropriate for only one loading level and cannot be changed without removing the roll from the machine. Controlled-crown rolls have been used for many years with some success and can be useful for altering nip load distribution, but only in a very broad sense. This is because control crown rolls operate by applying internal pressure to the metal roll shell, which is quite thick and necessarily very stiff. They are not useful for addressing local moisture problems, since CD nip loading cannot be controlled over short distances.

The most effective moisture profiling strategy in the press section is probably the use of steam boxes or infrared preheat ahead of the press nip. These devices facilitate nip dewatering by lowering the viscosity of water in the web. Different amounts of sensible heat are added to the wet web across its width, in a manner corresponding with measured CD moisture profiles at a downstream location. In general, profiling steam boxes have been successful, as measured by elevated size press moistures, increased machine speeds and reduced CD moisture variability.

The main shortcomings of steam box use are three. First is the increase in web density as the web is pressed at a higher temperature. Densification in the nip increases with increasing temperature, making this an unacceptable strategy for many bulk-sensitive grades. Second is the practical limitation on CD control width segments in the steam box. Typically, one to four foot wide control zones are employed. In many instances, it would be desirable to obtain a finer degree of CD control. Thirdly, steam boxes positioned above the web are prone to drip condensate onto the moving web, thereby compromising product quality.

As used herein, the term roll cover refers to a nonmetallic covering, 0.1 to 2.0 inches thick, of a cylindrical shaft or solid cylinder. Common roll cover materials include, but are not limited to, rubber and polyurethane compounds and variations thereof.

Roll covers can be characterized by their modulus of elasticity, which is a ratio of incremental stress to the resulting incremental strain. This property is dependent on the composition of the material in question, among other things. Changes in the modulus of elasticity of a roll cover affect the shape and magnitude of machine direction pressure profile in a rolling nip. The term effective modulus as used in this invention is intended to designate any cover property which, when changed, can similarly affect the pressure profile in a rolling nip. Changes in cover density, thickness, firmness, hardness, compressibility, position relative to the roll shaft, and the like are hereby referred to as equivalent to changes in the effective modulus of the cover.

Previous attempts to control the stiffness, hardness, or resiliency of a roll cover which are related to the present invention can be found in U.S. Pat. Nos. 4,928,593 (Ruckl)

and 5,634,606 (Roder). These inventions rely on an inflatable elastic bag ('593) or annular gas filled cells ('606), located under the subject roll cover, which can be pressurized to various levels. In the third embodiment of Roder's press-on roller ('606), a plurality of annular gas-filled cells spaced along the width of the roll, each cell equipped with a dedicated pressure valve, is proposed for CD profiling of the nip pressure. However, the press-on roller in '606 would not be suitable for use in the paper machine.

The present invention overcomes the limitations of existing technologies for improving CD moisture uniformity in the press section. The basis for this invention is that intrinsic, or effective, properties in the roll cover itself are controlled in a fashion that makes possible much higher CD control resolution. Further, the present invention provides means for globally changing the hardness of the roll cover across its entire width, thereby allowing different cover hardnesses to be used as situations dictate. For example, in some press positions, softer roll covers may be better suited for heavier weight grades of paper in order to extend nip dwell time, while harder covers may be preferred for lighter weight grades which require less dwell time but greater nip pressure. Changing cover properties across the full roll width also provides the papermaker a tool with which to eliminate certain quality or production problems, including poor water removal efficiency, crushing in the first nip, felt marking, excessive densification on bulk sensitive grades, and the like.

In the present invention, roll cover properties are altered and controlled in a manner such that the shape and magnitude of the pressure pulse in a nip formed by two rolls, a roll and a blade, or a roll and a rod, is controlled to a desired level. This is accomplished by incorporationg an electorheological or magnetorheological elastomer into the roll cover and using an electric field or a magnetic field to stimulate the elastomer such that its physical properties are effectively changed.

As used herein, the term electrorheological elastomer refers to any of various elastomeric compounds, including but not limited to rubber and polyurethane, which contain or are in close proximity to polarizable particles which can be acted upon by an external electric field. The particles can be located in any of a variety of configurations relative to the elastomeric compound. For example, discrete droplets of electrorheological fluid (ERF) can be dispersed throughout the cover material during the cover's manufacture, such that there will always be a reserve of active particles during the life of the roll cover. The cover, which serves as a carrier for the particles, should be non-conductive. As another example, one may suspend the polarizable particles not in viscous fluid pockets or droplets, but rather in the form of a viscoelastic solid or electrorheological gel (ERG) as taught in U.S. Pat. Nos. 5,607,996 (Nichols et al) and 5,364,565 (Li et al). Such material is described as an electrorheological solid (ERS). Viscoelastic properties such as loss factor and shear modulus for these materials are controlled by the electric field used.

Similarly, the term magnetorheological elastomer is used as the magnetic analog of the electrorheological elastomer discussed above. While several methods exist for introducing the magnetizable particles in or close to the roll cover elastomer, the method discussed by Watson (U.S. Pat. No. 5,609,353) which relates to a magnetoviscoelastic solid is of special interest.

The present invention is not limited to press section roll covers for improved CD moisture profile. The concept can be applied to size press and coater backing rolls for more uniform coat-weight application and coating distribution across the web thickness. It can also be applied to the covered rolls in virtually any type of calender (gloss, hot-soft, super, extended nip, etc.), depending on temperature limitations. The invention is useful in improving smoothness, gloss, and caliper profiles when used in a calendering process. One method of altering the intrinsic or effective roll cover properties over short distances involves the use of electrorheological (ER) materials or magnetorheological (MR) materials imbedded within the cover or directly under the cover.

Numerous technical articles on electrorheological (ER) fluids have been written. For example, the *Journal of Rheology*, Vol. 42, issue 3, May/June 1998, contains the following articles: (1) Kanu, R., and Shaw, M., "Enhanced Electrorheological Fluids Using Anisotropic Particles," pp. 657–670; (2) Rankin, P., and Klingenberg, D., "The Electrorheology of Barium Titanate Suspensions," pp. 639–656; and (3) Yao, N., and Jamieson, A., "Electrorheological Creep Response of Tumbling Nematics," pp. 603–619. Each of these articles cites numerous references themselves. Potential uses of ER fluids, as mentioned by Rankin and Klingenberg, include shock absorbers, engine mounts, clutches, brakes, artificial joints, among others.

One example of the use of an electrorheological (ER) fluid for changing the effective hardness of a hollow elastomer member is shown in U.S. Pat. No. 5,390,974 issued to Theodorakakos. A number of plates are positioned within the hollow member and when the plates are charged, the stiffness of the elastomer increases. A similar result is achieved, using an elastomer impregnated with a fine powder, the powder polarizing when subjected to an electric field and changing the viscoelasticity of the elastomer, by the disclosure of U.S. Pat. No. 5,290,821 issued to Sakurai et al. Another example of the use of an electric field to change the stiffness of an elastomer containing polarizable particles is shown in U.S. Pat. No. 5,607,996 issued to Nichols et al. U.S. Pat. No. 5,609,353 issued to Watson discloses an elastomer suspension for an automobile bushing, the bushing having embedded therein a plurality of iron particles, the latter suspended in a carrier of low magnetic permeability. The magnetic field from a contiguous coil acts upon the iron particles to thus vary the elastomer stiffness. Hence the worker in this art may use either embedded polarizable particles or embedded magnetic particles, to vary the stiffness of an elastomer member. Each of the above literature references and patents is hereby incorporated by reference.

SUMMARY OF THE INVENTION

According to the practice of this invention the intrinsic mechanical properties of a roll cover are altered by using an external stimulus such that nip pressure (for example, on a paper web) can be controlled in 20 inches wide or less zones across the width of the nip. Such roll cover alterations may take place in the press section, the size press and coater, and in the calender (hot-soft, gloss, super-calender, and the like).

The invention relates to a method and apparatus for controlling nip dynamics across the width of a nip created between two rolls or a roll and a blade. This is accomplished by controlling the intrinsic or effective properties of the cover of at least one roll. In one embodiment of the invention, the roll cover is impregnated with small droplets, particles or other foreign material which alter either the density or the effective modulus of the cover when exposed to an external or internal stimulus such as an electric or magnetic field. The stimulus itself is controlled in the cross-machine direction in a manner resulting in CD control of the cover properties. If the stimulus is an electromagnetic field, it may be located within the interior of the roll, such as under the cover in circumferential strips of complete angular extent (360°), or external to the roll cover, depending on the time constant and the response of the foreign material which changes the modulus of the roll cover.

The foreign material is introduced during manufacture of the roll cover material. One foreign material which may be employed is an electrorheological fluid existing in the form of droplets distributed in discrete pockets throughout the cover. Droplet distribution can be uniform throughout the thickness of the roll cover, or can be non-uniform. Various technologies exist for ensuring an adequately controlled distribution of such droplets, as evidenced by commercialization of Fuji pressure-sensitive film.

The preferred external stimulus depends on the type of foreign material (magnetic particles, polarizable dipoles, infrared scatterers and absorbers, chemically reactive agents) impregnated into the roll cover. Stimuli may include electric and magnetic fields, heat, ultrasound and nuclear radiation. One combination is the use of an electromagnetic field as a stimulus which acts upon small droplets of electrorheological material (e.g., liquid or gel) embedded within the cover. Depending on the field strength, the rheology of the foreign material changes, thereby changing the effective modulus or stiffness/hardness of the cover.

Kanu and Shaw (cited above) report that dynamic modulus of an ER fluid can increase one or more orders of magnitude, depending on particle aspect ratio. In CD locations where the applied field creates a higher effective modulus, the machine direction pressure profile in the nip would change shape, creating higher peak pressures at mid-nip. Nip dewatering efficiency would change, the direction of which would depend on product and process parameters. In many instances, nip dewatering would increase in this area.

As a result of controlling press roll cover properties across the roll width (CD), those locations corresponding to high moisture areas in the paper may be varied to increase dewatering, thereby creating a more uniform CD moisture profile. Using this invention on a calender roll cover, locations corresponding to higher sheet roughness, excessive caliper, or lower sheet gloss, may be controlled to provide higher nip pressure, thereby producing a more uniform paper web.

The concept of controlling nip dynamics in the papermaking art, by directly controlling the intrinsic properties of a roll cover, has not previously been attempted. By this invention, significantly higher CD resolution can be achieved than possible with control-crown rolls, the former allowing selective treatment of both high and low moisture areas in the web. This results in more level moisture profiles. Within the scope of this invention, the profile of the nip through which the moisture containing paper web passes may be deliberately made non-uniform, so as to yield any desired moisture profile, as well the usually desired uniform moisture profile.

In carrying out the invention, known moisture profile sensing apparatus is positioned downstream of the elastomer rolls, and the web moisture profile determined, either continuously or intermittently. Then, energy is applied to selected electric field producing plates or magnetic field generating coils to vary the effective modulus of the elastomer, which changes the nip pressure pulse and nip dwell time, thereby locally affecting water removal. The specific plates or coils energized may be controlled by known feedback techniques and apparatus. An example of downstream measuring of paper web moisture content, with feedback to control (upstream) forces on the roll ends only, is shown in U.S. Pat. No. 3,619,359 issued to Keyes. U.S. Pat. No. 3,666,621 issued to Adams and U.S. Pat. No. 4,500,968 issued to Bialkowski also disclose the monitoring of web moisture of a paper web.

The purpose of the electric or magnetic fields is to control the effective modulus of the roll cover in each width-wise zone. The baseline electric or magnetic field strength may be either zero or some positive value. For a zero baseline field strength, the effective modulus of the cover at any particular width-wise location will be changed only by adding energy to that zone which generates the required field strength. For a positive baseline field strength, the effective modulus at any widthwise zone can be changed by either increasing or decreasing that zone's field strength, depending on the desired end result. This allows the user the ability to make the roll cover either harder or softer relative to its nominal (baseline) hardness.

BRIEF DESCRIPTION OF THE DRAWINGS

FIG. 5B is thus a nip pressure profile along the entire width of the nip.

DETAILED DESCRIPTION OF THE INVENTION

Figure 1:
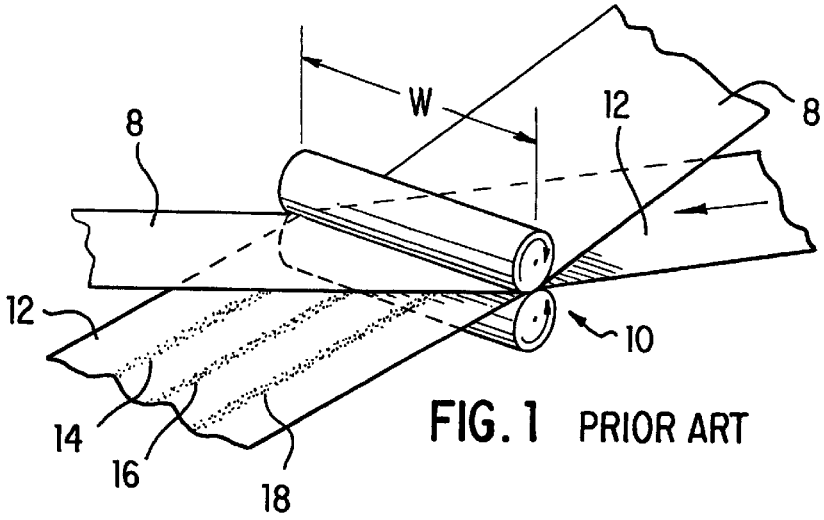
FIG. 1 PRIOR ART
FIG. 1 is a perspective view of a typical prior art arrangement showing a paper web passing through the nip of two rolls, in combination with a single felt.

FIG. 1 of the drawings shows a pair of rolls 10, in the press section, whose nip applies pressure to the opposing surfaces of a paper web 12 of indefinite length, the latter moving from right to left, as indicated by the arrow. The web may be in contact with one or more felts 8. The moisture profile is often non-uniform because zones 14, 16, 18 may be of either increased or decreased moisture, relative to a desired moisture content. The width of the rolls is denoted as W, while the direction at right angles to the direction of web motion is termed the web cross direction and is often denoted as CD. The terms "nip profile" or "moisture profile" will refer to the variation of web moisture in the cross direction. FIG. 1 thus shows a typical prior art apparatus/method wherein variations in CD moisture content occur, such variations often termed "streaking". The reader will understand that either of the rolls 10 may be covered or uncovered, and further that a knife or blade or rod may be, as is conventional, substituted for one of the rolls.

Figure 2:
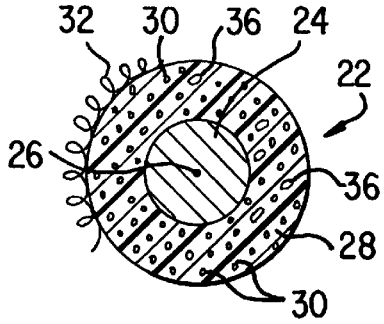
FIG. 2 is a transverse cross section of a roll provided with an elastomer cover according to the invention, the cover having particles and/or pockets of particles embedded therein, and an external coil for generating a field which acts upon the particles to change the hardness/stiffness of the elastomer cover.

In accordance with this invention, streaking is essentially eliminated, or significantly reduced, by varying the effective modulus of the roll cover or covers at selected regions or zones across the width of the rolls. FIG. 2 shows this as carried out by providing at least one of the rolls 22 of a roll pair with magnetic particles which are acted on by the field to vary properties of the elastomer roll cover. A metal roll 24 having a longitudinal axis of rotation 26 is covered with an elastomer cover 28, the cover being impregnated with magnetic particles 30 embedded therein. An external stationary coil 32 is positioned contiguous to the roll cover. Upon energizing the coil the coil by an electric current, the particles move align themselves and thus vary the hardness/stiffness of the elastomer. A plurality of spaced coils 32 is provided along the width of the covered roll, each coil thus generating a local magnetic field, with each coil being individually controlled as to its resulting field strength. The nip pressure pulse is thus controlled at spaced locations along the roll nip to thus variably squeeze the paper web. If one or both rolls of FIG. 1 were formed as shown at FIG. 2, then FIG. 1 would show the rolls/method of this invention. FIG. 2 also illustrates a plurality of pockets 36 embedded in elastomer cover 28 in lieu of, or in addition to, particles 30. Each pocket 36 may contain magnetic particles suspended in a liquid, to thus yield a similar change in stiffness/hardness of the elastomer upon the application of a local magnetic field.

Figure 3:
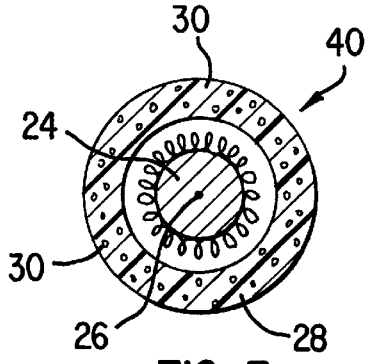
FIG. 3 is a view similar to FIG. 2 and wherein a coil for generating a field is positioned between a roll and a cover for the roll.

FIG. 3 shows, also in transverse cross section, a roll construction 40, similar to that of FIG. 2, but wherein a magnetic field generating coil 38 is positioned annularly around metal roll 24 and interiorly of elastomer cover 28. Again, the field generated by coil 38 acts upon the particles 30 to change the properties of the elastomer cover. As with the construction of FIG. 2, each of a plurality of coils 38 is spaced across the width of the roll or rolls to generate a local magnetic field so as to locally vary the stiffness/hardness of the elastomer at width-wise spaced regions of the roll. Again, pockets 36 having magnetic particles suspended in a liquid may be used in the cover of FIG. 3, instead of or in addition to particles 30.

Figure 4:
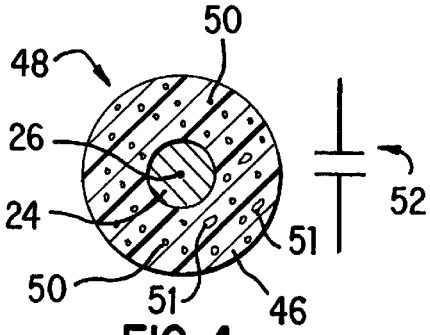
FIG. 4 is a view similar to FIG. 2 wherein the elastomer cover is provided with pockets of an electrorheological fluid (ER), the ER fluid effectively changing the hardness and/or stiffness of the roll cover upon the application of a field.

Turning now to the embodiment of FIG. 4, a roll 48 of a papermaking machine includes a central shaft 24, typically of metal, having a central axis of rotation 26, the shaft provided with an elastomer cover 46. Cover 46 contains particles 50 of polarizable material embedded therein. Spaced and conductive plates 52 are positioned contiguous to the roll, such that an electric field is generated when a voltage is applied to the plates. The electric field causes polarization of the particles and an attendant increase in stiffness/hardness of the elastomer at those elastomer regions contiguous or nearby to plates 52. The action of the electric field on the particles, and hence the elastomer, is similar to that described in the above noted U.S. patents to Sakurai, Theodorakakos, and Nichols. In the present invention, each of a plurality of plate pairs is spaced along the width of the roll so that various width-wise spaced zones of the elastomer cover may selectively be stiffened to locally increase nip pressure. The degree of stiffening is dependent on the strength of the applied filed, which may be variable. It is seen that FIG. 4 shows only one such plate pair. Instead of, or in addition to, particles, cover 46 may be provided with pockets 51 which contain polarizable particles suspended in a liquid.

Figure 5A:
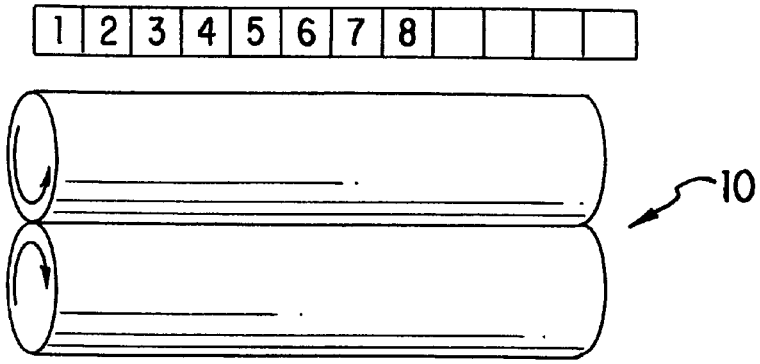
FIG. 5A is a schematic view showing a pair of rolls divided across their width into zones, the latter indicated at the top of the Figure.

Turning now to FIG. 5A, a portion of a typical prior art press section of a papermaking machine is shown. A pair of press rolls 10 is illustrated, with numbered zones or regions along the width of the rolls shown above the upper roll.

Directly beneath, at plot 5B, the nip pressure exerted by the rolls on a paper web passing therethrough is shown as essentially uniform over the width of the rollers. This uniformity is shown by a horizontal line.

Figure 5B:
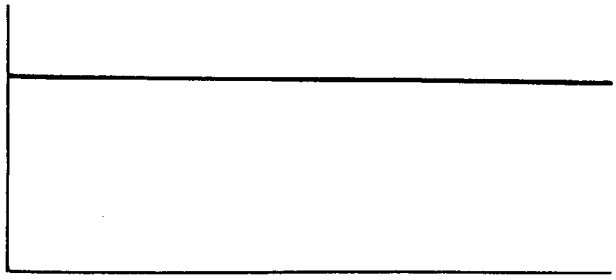
FIG. 5B is a plot showing the pressure in the nip of the rolls of FIG. 5A on a paper web (not shown) passing through the nip.
Figure 5C:
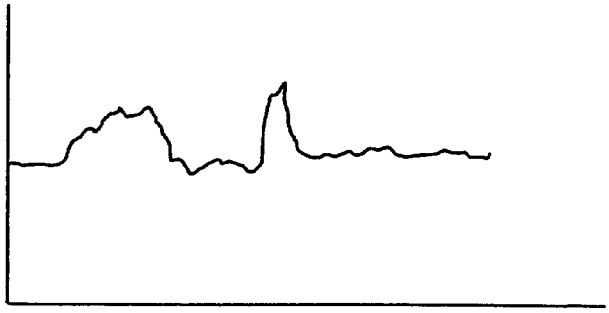
FIG. 5C is shows the CD moisture profile of a paper web which has passed through the nip of the rolls of FIG. 5A.

At FIG. 5C, a typical non-uniform moisture profile of a paper web which has passed through the nip is shown. In spite of uniform nip pressure, naturally occurring anisotropies in the paper web (non-uniform web weight, non-uniform moisture content before the nip, non-uniform web thickness, etc.) of various portions along the width and length of the web can result in different moisture contents of adjacent regions of the web. Thus a uniform nip pressure, as shown at FIG. 5B, will not necessarily result in a uniform moisture profile downstream of the nip.

Figure 6A:
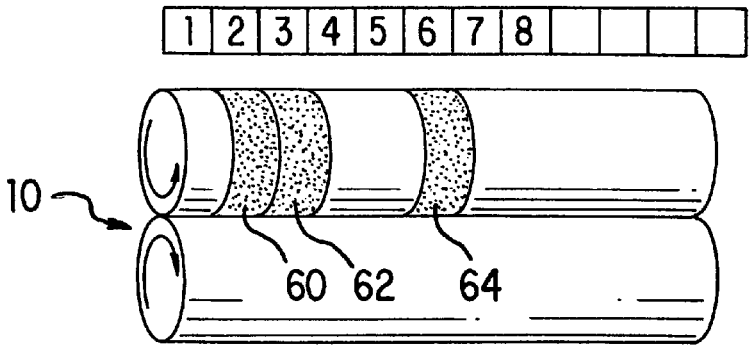
FIG. 6A is a view similar to FIG. 5A and shows the location of discrete field generating elements spaced along the width of the rolls in accordance with this invention.

At FIG. 6A, at least the upper roll of press roll pair 10 is defined by a roll of this invention, namely, a roll fashioned according to any of FIGS. 2 to 4. The shaded zones 60, 62, and 64 of the upper roll represent those roll zones or regions which have been actuated, as by magnetic fields from coils or electric fields from spaced plates. The numbered squares above the upper roll represent the locations of the individual field generating coils (for an MR elastomer) or pairs of charging plates (for an ER elastomer).

Figure 6B:
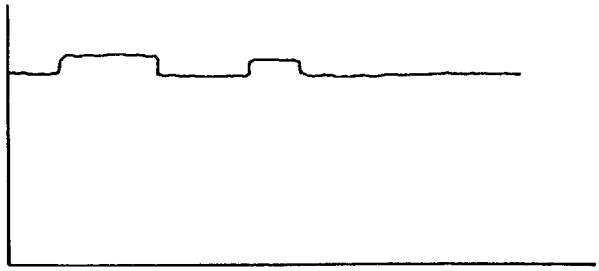
FIG. 6B is a plot similar to FIG. 5B and shows the nip pressure variation or profile across the width of the rolls by energizing selected coils/plates across the rolls.
Figure 6C:
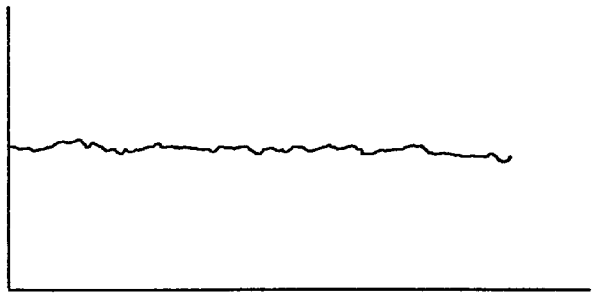
FIG. 6C shows the CD moisture profile of a paper web which has passed through the nip of the rolls shown at FIG. 6A.
Figure 7:
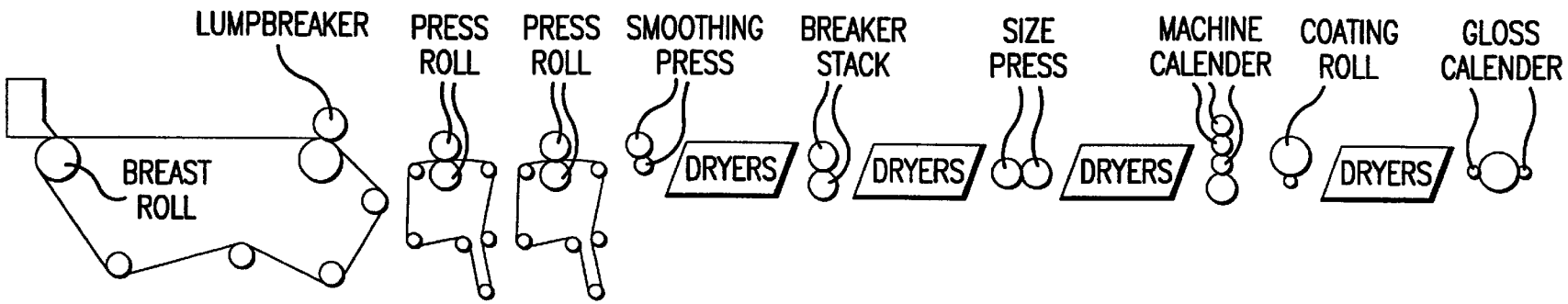
FIG. 7 is a representation of a typical, known papermaking machine having a number of different stations. The function of each station is indicated, e.g., a size station, a gloss station, a press station, etc. Each station may be provided with a roll or rolls to define at least one nip at each station, and the roll or roll cover of this invention may be used for the roll or rolls indicated at the several stations.

At FIG. 6B, the increase of nip pressure at locations corresponding to 60, 62, and 64 is shown, being in the form of increases in height from a base value. At FIG. 6C the web moisture profile is shown. It is seen that the moisture profile FIG. 6C is nearly uniform, as compared with the moisture profile of FIG. 5C. The reader will note that the increases in nip pressure at FIG. 6B are homologous to the increases in moisture content at FIG. 5C. Considering FIGS. 5A and 6A as differing only in the type of rolls employed, it is seen that the application of this invention to the same paper web results in a substantially uniform moisture profile, the regions (peaks) of higher moisture content of FIG. 5C having been pressed or squeezed more than adjacent regions by virtue of the non-uniform nip pressure shown at FIG. 6B, in turn caused by increasing the effective modulus of the upper roll of FIG. 6A at those width-wise roll regions 60, 62, 64 homologously located relative to the moisture peaks of FIG. 5C.

Thus, in the event that the peaks in moisture content shown at FIG. 5C were at different width-wise web locations, then different elastomer cover roll zones, corresponding to zones 60, 62, 64, etc., would be actuated to increase the effective modulus, and hence local increases in nip pressure, at these zones.

In practice, conventional web moisture measuring apparatus is employed downstream of the rolls. The width-wise location of the web moisture is measured and this information is fed back to the energy sources for selectively energizing the appropriate coils and plates contiguous to the elastomer roll covers. This action makes possible the web moisture profile changes described and shown in FIGS. 5C and 6C. U.S. Pat. Nos. 3,619,359 issued to Keyes, 3,666,621 issued to Adams, and 4,500,968 issued to Bialkowski disclose such apparatus. The Keyes patent is particularly relevant in showing that it is known to employ a feedback action to monitor and change CD paper web moisture distribution.

The reader will recognize that the elastomer roll covers may be actuated such that the nip pressure is uniformly high, or uniformly low, with the relative terms high and low depending on the desired state of operation. Further, the effective modulus of the elastomer may be locally decreased, as well as locally increased. Local increases have been described with respect to FIGS. 5A and 6A. By suitable actuation of the spaced coils or plates, any desired profile or variation of nip pressure may be realized.

The paper web may contact the outer surfaces of a pair of the rolls of this invention, or one or more endless felts may be in contact with the paper web. In any event, the nip pressure is varied by changing the effective modulus of the elastomer at selected regions or zones of the outer surface of the roll or rolls. Thus, in the cases where the paper web is completely sandwiched by two felts, or is contacted by only one felt, or is not contacted by any felt, the nip through which the paper web passes is said, within the meaning of this description, to include an elastomer roll.

What is claimed is:

1. A roll for a papermaking machine, said roll having an elastomer based cover formed from an elastomer selected from the group consisting of electrorheological and magnetorheological elastomers, a plurality of individual actuating elements spaced along the width of said roll, said actuating elements each being individually energizable to produce a field selected from the group consisting of electric and magnetic fields, said field acting upon said elastomer cover to either locally vary the effective modulus of said cover along spaced regions of the width of said roll, or to uniformly vary the effective modulus of said roll along its entire width.

2. The roll of claim 1 wherein said actuating elements are located exteriorly of said elastomer cover.

3. The roll of claim 1 wherein said actuating elements are located interiorly of said elastomer cover.

4. The roll of claim 1 wherein said roll cover is formed from an electrorheological elastomer, and wherein said field is an electric field.

5. The roll of claim 1 wherein said roll cover is formed from a magnetorheological elastomer, and wherein said field is a magnetic field.

6. An elastomer roll for a papermaking machine, the elastomer of said roll selected from the group consisting of electrorheological and magnetorheological elastomers, a plurality of individual actuating elements spaced along the width of said roll, said actuating elements each being energizable to produce a field selected from the group consisting of electric and magnetic fields, said field acting upon said elastomer to locally vary the effective modulus of said elastomer along spaced local regions of the width of said roll, wherein said modulus may be varied either locally along the width of said roll or uniformly along the width of said roll.

7. The roll of claim 6 wherein said actuating elements are located exteriorly of said elastomer.

8. The roll of claim 6 wherein said actuating elements are located interiorly of said elastomer.

9. The roll of claim 6 wherein said roll is formed from an electrorheological elastomer, and wherein said field is an electric field.

10. The roll of claim 6 wherein said roll is formed from a magnetorheological elastomer, and wherein said field is a magnetic field.

* * * * *